US010773354B2

(12) United States Patent
Chuang

(10) Patent No.: US 10,773,354 B2
(45) Date of Patent: Sep. 15, 2020

(54) GRINDING MACHINE WITH TRANSVERSE MOVING UNIT

(71) Applicant: YEON CHUAN MACHINERY CO., LTD., Taichung (TW)

(72) Inventor: Po Chang Chuang, Taichung (TW)

(73) Assignee: Yeon Chuan Machinery Co., Ltd., Taichung (TW)

( * ) Notice: Subject to any disclaimer, the term of this patent is extended or adjusted under 35 U.S.C. 154(b) by 159 days.

(21) Appl. No.: 15/864,133

(22) Filed: Jan. 8, 2018

(65) Prior Publication Data

US 2019/0193228 A1 Jun. 27, 2019

(30) Foreign Application Priority Data

Dec. 21, 2017 (TW) ..... 106218937 U

(51) Int. Cl.

| | |
|---|---|
| ***B24B 7/07*** | (2006.01) |
| ***B24B 7/08*** | (2006.01) |
| ***B24B 41/047*** | (2006.01) |
| ***B24B 47/12*** | (2006.01) |
| ***B24B 41/06*** | (2012.01) |

(52) U.S. Cl.

CPC ..... *B24B 7/075* (2013.01); *B24B 7/07* (2013.01); *B24B 7/08* (2013.01); *B24B 41/047* (2013.01); *B24B 41/068* (2013.01); *B24B 47/12* (2013.01)

(58) Field of Classification Search

CPC .. B24B 7/07; B24B 7/075; B24B 7/08; B24B 41/047; B24B 41/0475; B24B 41/053; B24B 41/068; B24B 47/10; B24B 47/12

USPC ..... 451/121, 124

See application file for complete search history.

(56) References Cited

U.S. PATENT DOCUMENTS

| | | | | |
|---|---|---|---|---|
| 2,587,177 A * | 2/1952 | Larson | B25H 1/04 | 144/286.1 |
| 4,955,941 A * | 9/1990 | Rousseau | B23D 47/025 | 108/65 |
| 6,299,512 B1 * | 10/2001 | Costa | B24B 7/28 | 451/300 |
| 6,722,966 B1 * | 4/2004 | Wang | B24B 21/12 | 451/168 |
| 6,860,797 B1 * | 3/2005 | Chuang | B24B 7/28 | 451/155 |
| 6,881,136 B1 * | 4/2005 | Chuang | B24B 21/04 | 451/304 |
| 7,014,544 B2 * | 3/2006 | Huang | B24B 7/28 | 451/120 |
| 7,090,569 B1 * | 8/2006 | Chang | B24B 21/22 | 451/120 |

(Continued)

*Primary Examiner* — Eileen P Morgan

(74) *Attorney, Agent, or Firm* — Rosenberg, Klein & Lee

(57) ABSTRACT

A grinding machine includes a base having a plate and a movable device which is connected to the plate. A driving unit is connected to one end of the base and includes having a first motor which has a hollow shaft. An oval hole is defined in the hollow shaft. A grinding unit is located across the top of the plate and includes a body and a grinding part. The grinding part is slidably connected to a slot of the body and has a shaft unit which is located in the oval hole of the hollow shaft. A transverse moving unit is connected to the grinding part and has a second driving motor. A cam link is connected between the driving motor and the grinding part. The grinding part is moved transversely relative to the plate by the cam link driven by the second driving motor.

6 Claims, 10 Drawing Sheets

(56) References Cited

U.S. PATENT DOCUMENTS

| | | | | |
|---|---|---|---|---|
| 7,572,170 | B2 * | 8/2009 | Chang | B24B 7/00 451/11 |
| 8,287,335 | B2 * | 10/2012 | Chang | B24B 7/075 451/11 |
| 9,950,403 | B2 * | 4/2018 | Kroplin | B24B 27/033 |
| 2005/0287935 | A1 * | 12/2005 | Huang | B24B 7/28 451/124 |
| 2016/0332275 | A1 * | 11/2016 | Kroplin | B24B 27/033 |

* cited by examiner

GRINDING MACHINE WITH TRANSVERSE MOVING UNIT

BACKGROUND OF THE INVENTION

1. Fields of the Invention

The present invention relates to a grinding machine, and more particularly, to a transverse moving unit of a grinding machine so as to grind a larger area of an object.

2. Descriptions of Related Art

The conventional grinding machine is mainly used to grind metal or wood objects, and generally comprises a plate on which the object is positioned. In other words, the conventional grinding machine cannot grind the object that is wider than the plate. Besides, the conventional plate cannot be folded so that it occupies a lot space.

The present invention intends to provide a grinding machine that has a transverse moving unit so as to grind a larger area of an object.

SUMMARY OF THE INVENTION

The present invention relates to a grinding machine and comprises a base having a plate installed on top thereof, and a movable device is connected to the plate. A driving unit is connected to one end of the base and has a first motor which includes a hollow shaft with an oval hole. A grinding unit is located over a top of the plate and includes a body and a grinding part. The grinding part is slidably connected to a slot of the body. The grinding part has a shaft unit which is located in the oval hole of the hollow shaft. A transverse moving unit is connected to the grinding part of the grinding unit and has a second driving motor and a cam link. The cam link is connected between the second driving motor and the grinding part. The transverse moving unit is movable within the slot of the body to move the grinding part transversely relative to the plate.

Preferably, the shaft unit includes a shaft coupled to a grinding wheel. Two blocks are respectively connected to the shaft.

Preferably, the second driving motor is a variable-speed motor or a fixed-speed motor.

Preferably, the driving unit includes a frame to which the first motor is mounted.

Preferably, the frame includes a hook on one side thereof.

Preferably, the plate includes a main plate and two secondary plates which are respectively and pivotably connected to two sides of the main plate.

The primary object of the present invention is to provide a grinding machine that has a transverse moving unit so as to grind a larger area of an object.

Another object of the present invention is to provide a grinding machine wherein the plate can be folded.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
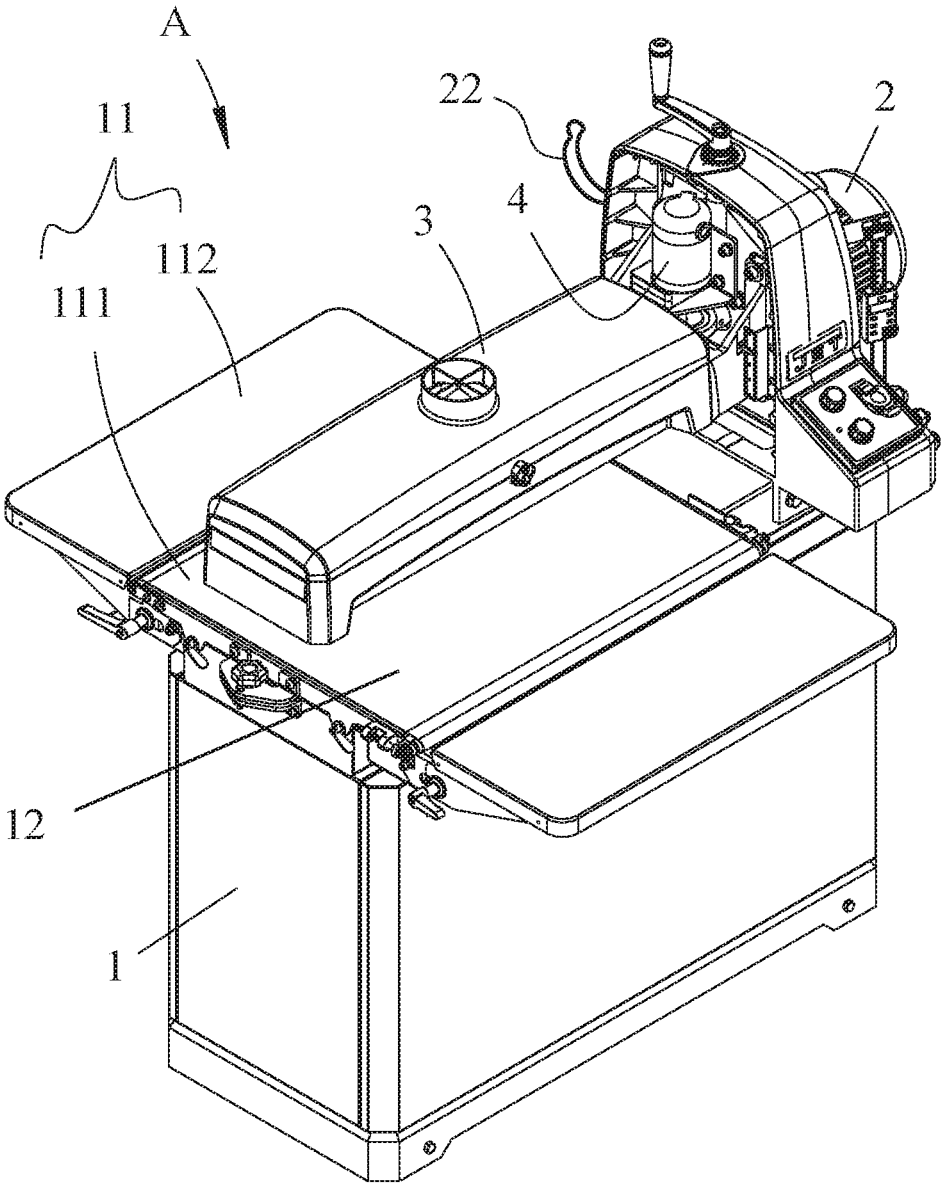
FIG. 1 is a perspective view to show the grinding machine of the present invention.

Referring to FIGS. 1 to 8, the grinding machine "A" of the present invention is designed to grind a wider object 5, and comprises a base 1 which includes a plate 11 on the top thereof, and a movable device 12 is provided on the plate 11 as shown in FIG. 1. The movable device 12 moves the object along the plate. The plate 11 includes a main plate 111 and two secondary plates 112 which are respectively and pivotably connected to two sides of the main plate 111.

A driving unit 2 is connected to one end of the base 1 and has a frame 20 on which a first motor 21 is mounted. The frame 20 includes a hook 22 on one side thereof as shown in FIG. 1 so as to hang other parts or tools. The frame 20 is able to adjust the height of the first driving motor 21. The first motor 21 drives a hollow shaft 211 which includes an oval hole 212 defined radially through the hollow shaft 211.

Figure 2:
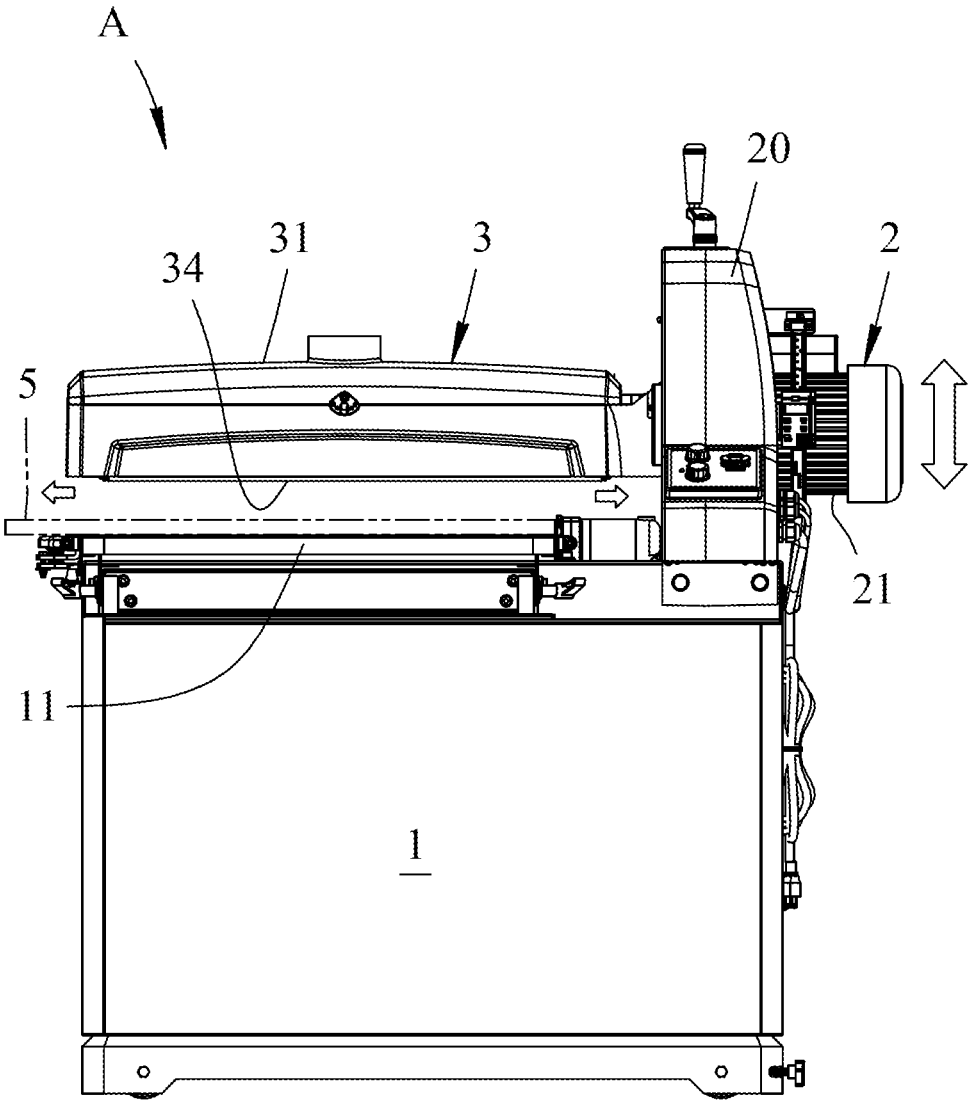
FIG. 2 is a side view to show the grinding machine of the present invention.
Figure 3:
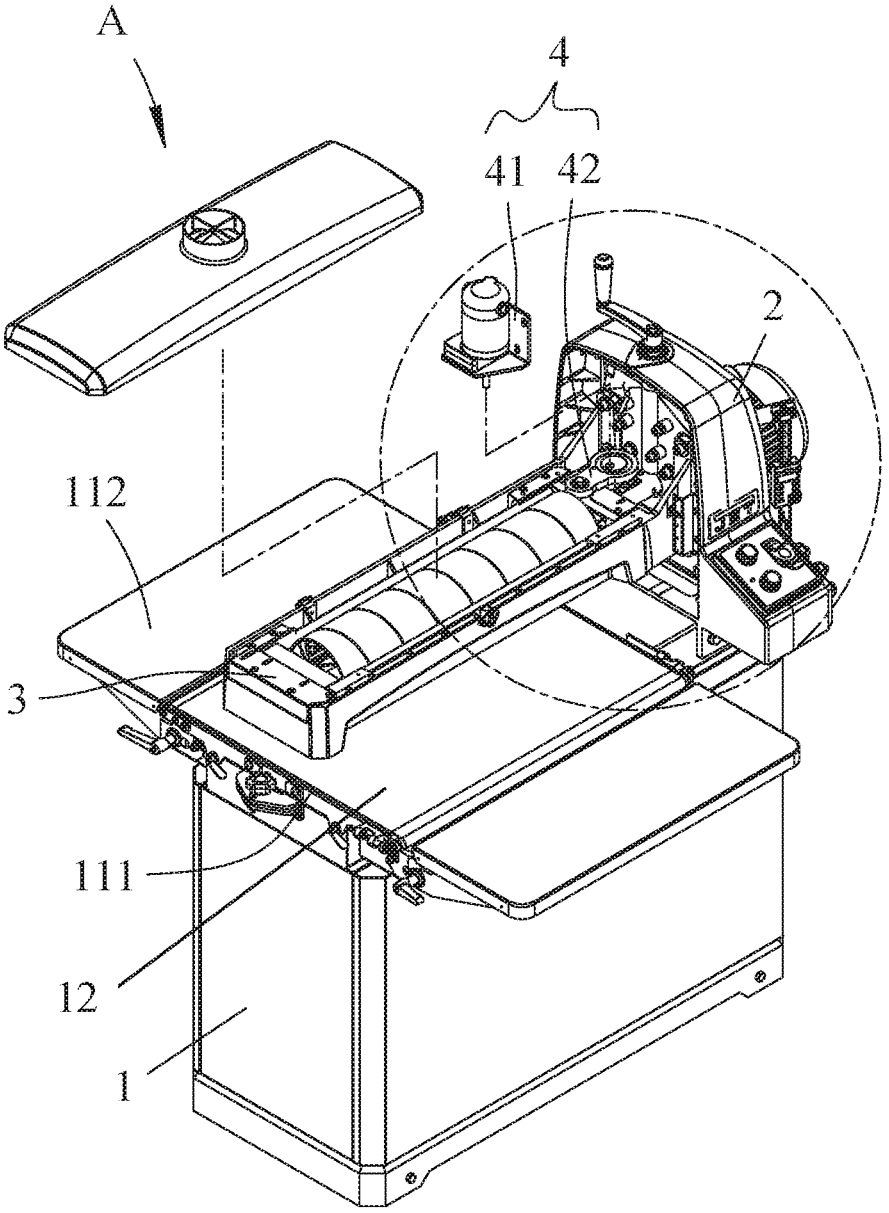
FIG. 3 is an exploded view of the grinding machine of the present invention.
Figure 4:
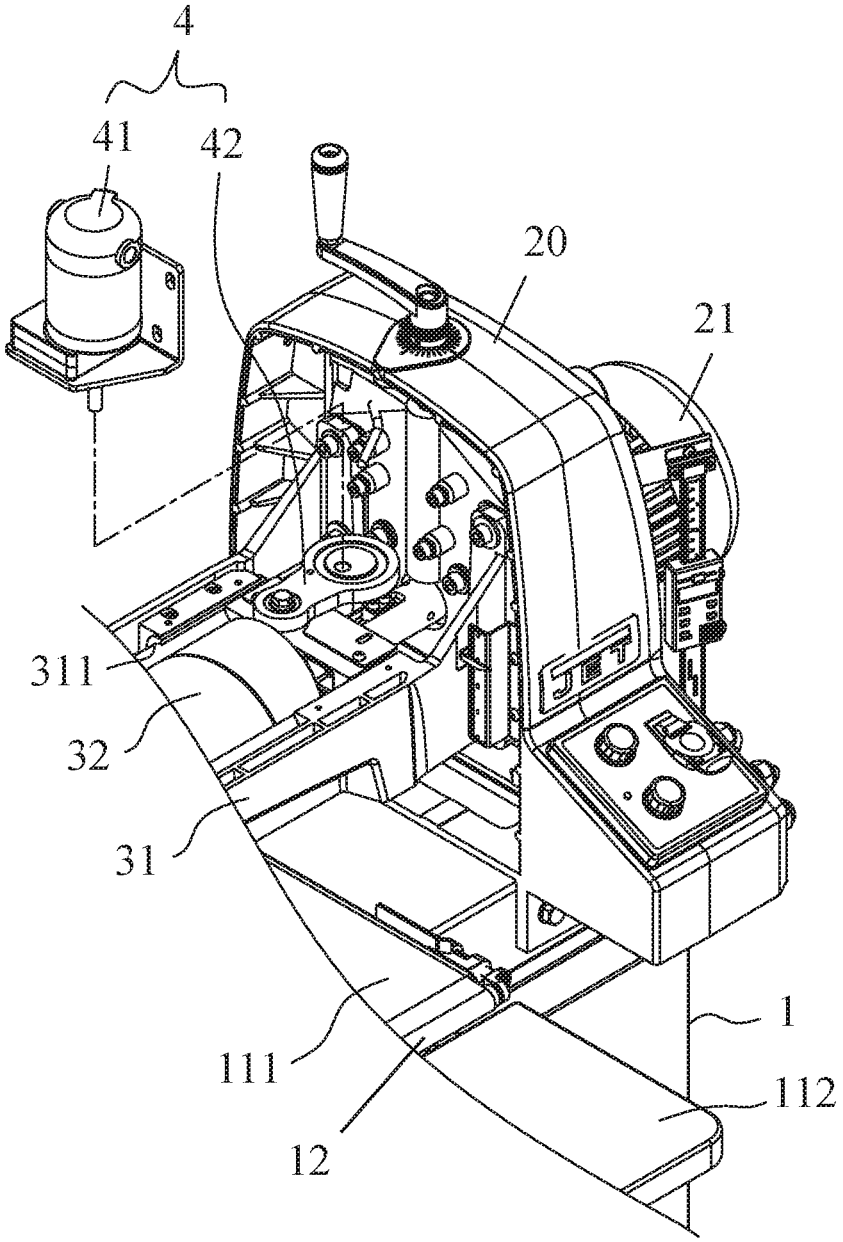
FIG. 4 is an enlarged view of a portion of the grinding machine of the present invention in FIG. 2.
Figure 5:
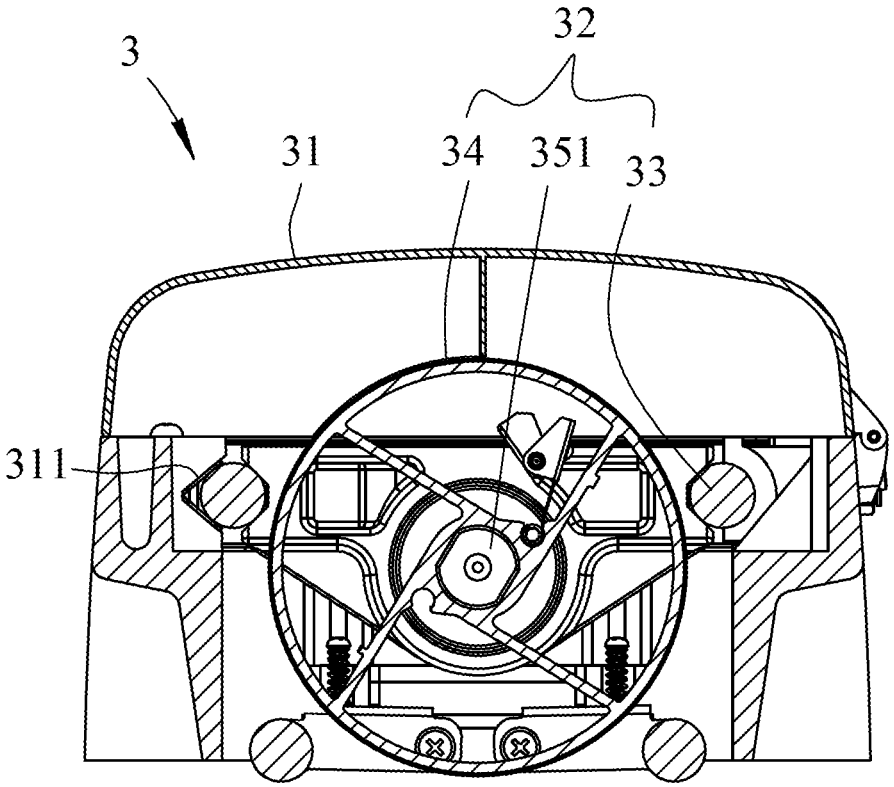
FIG. 5 shows the end cross sectional view of the transverse moving unit of the grinding machine of the present invention.
Figure 7:
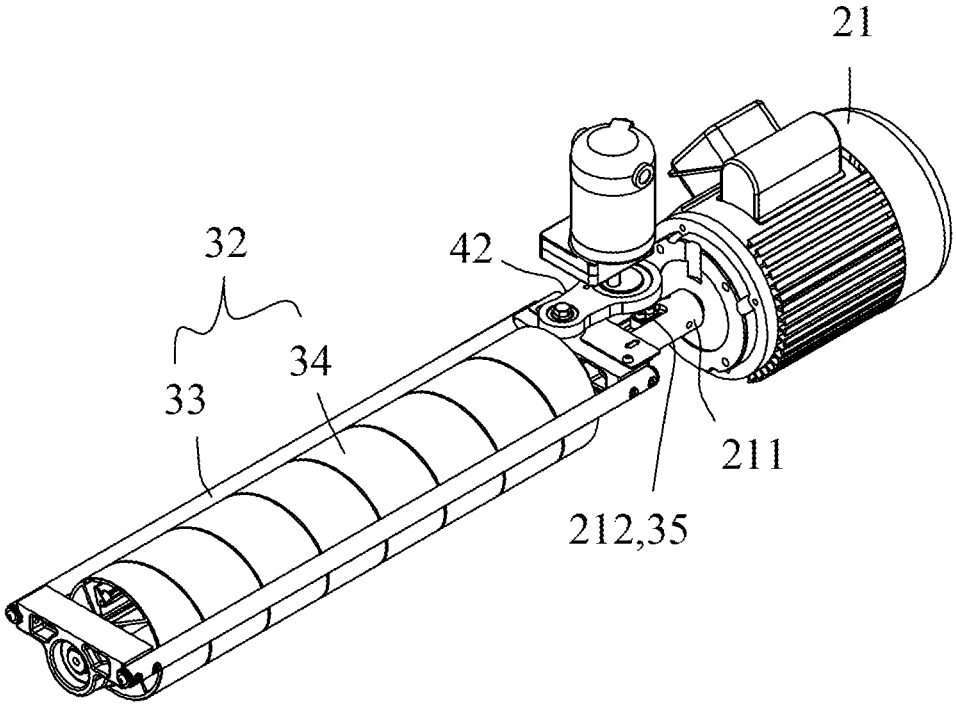
FIG. 7 shows that grinding wheel of the grinding part of the transverse moving unit is connected to be driven by the first driving motor.
Figure 8:
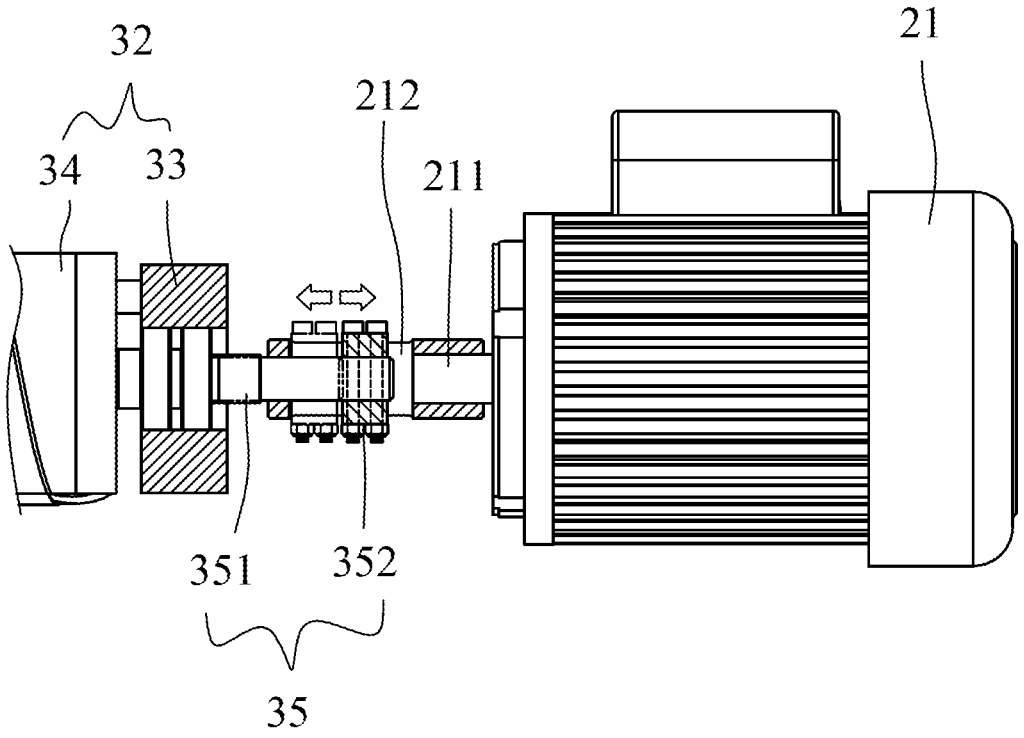
FIG. 8 shows another view of certain portions of the grinding part of the transverse moving unit connected to be transversely movable relative to a hollow shaft of the first driving motor.

A grinding unit 3 is located above the plate 11 and includes a body 31 and a grinding part 32. The grinding part 32 is slidably connected to a slot 311 of the body 31. The grinding part 32 includes a bracket 33 and a grinding wheel 34 for grinding the object 5 supported on the plate 11 underneath, as illustrated in FIG. 2. The grinding wheel is mounted to the bracket 33 and driven by a shaft unit 35 which engages the hollow shaft 211 of the first motor 21, as shown in FIGS. 7 and 8. The shaft unit 35 includes a shaft 351 and two blocks 352 respectively connected to the shaft 351 which extend out through the oval hole 212 to limit transverse movement of the shaft 351 relative to the hollow shaft 211, as indicated by the arrows in FIG. 8.

A transverse moving unit 4 is connected to the bracket 33 of the grinding part 32 of the grinding unit 3 and includes a second driving motor 41 and a cam link 42. The cam link 42 is connected between the second driving motor 41 and the bracket 33 of the grinding part 32. Specifically, the cam link 42 performs as a cam which the second driving motor 41 drives. The transverse moving unit 4 generates movement of the grinding part 32 along the slot 311 of the body 31 transversely relative to the plate 11. It is noted that the second driving motor 41 may be a variable-speed motor or a fixed-speed motor.

Figure 6:
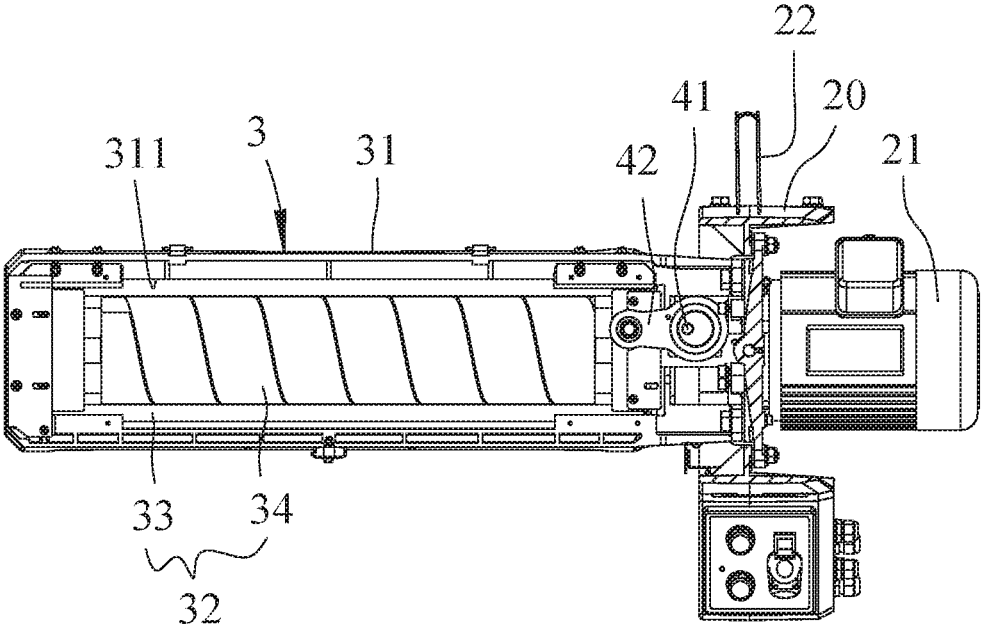
FIG. 6 is a top view of the transverse moving unit of the grinding machine of the present invention.
Figure 6A:
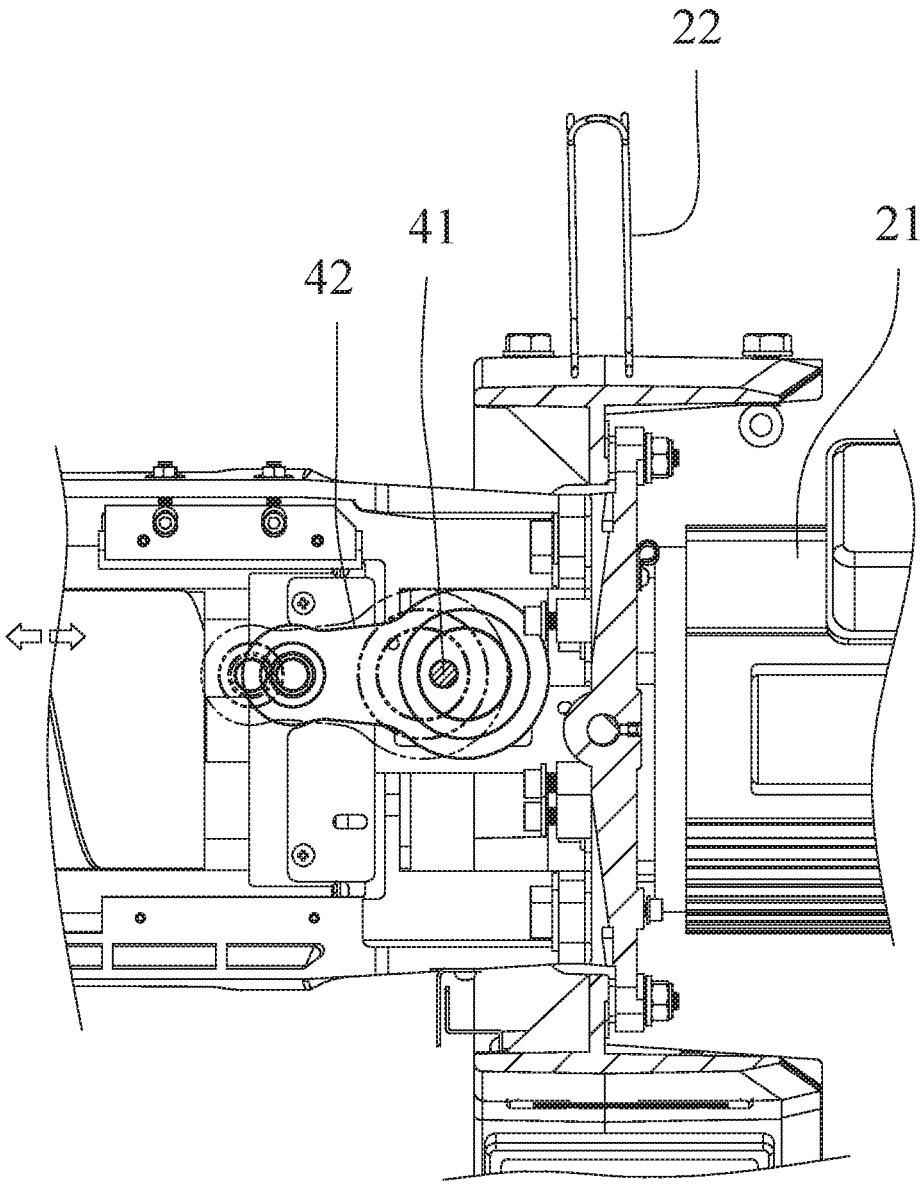
FIG. 6*a* shows the operational status of the transverse moving unit of the grinding machine of the present invention.

The second driving motor 41 drives the cam link 42, and the cam link 42 further drives the grinding part 32 to be movable in the slot 311 of the body 31 as shown in FIGS. 2 and 6*a*, so that the object having a larger width than the plate 11 can be ground thereon.

The second driving motor 41 shown is a variable-speed motor such that the speed that the transverse moving unit 4 moves transversely across the plate 11 can be controlled. When grinding a wider object 5 on the plate 11, the grinding part 32 can be controlled to be moved back and forth in the slot 311 by the transverse moving unit 4 to grind the wider object 5.

Figure 9:
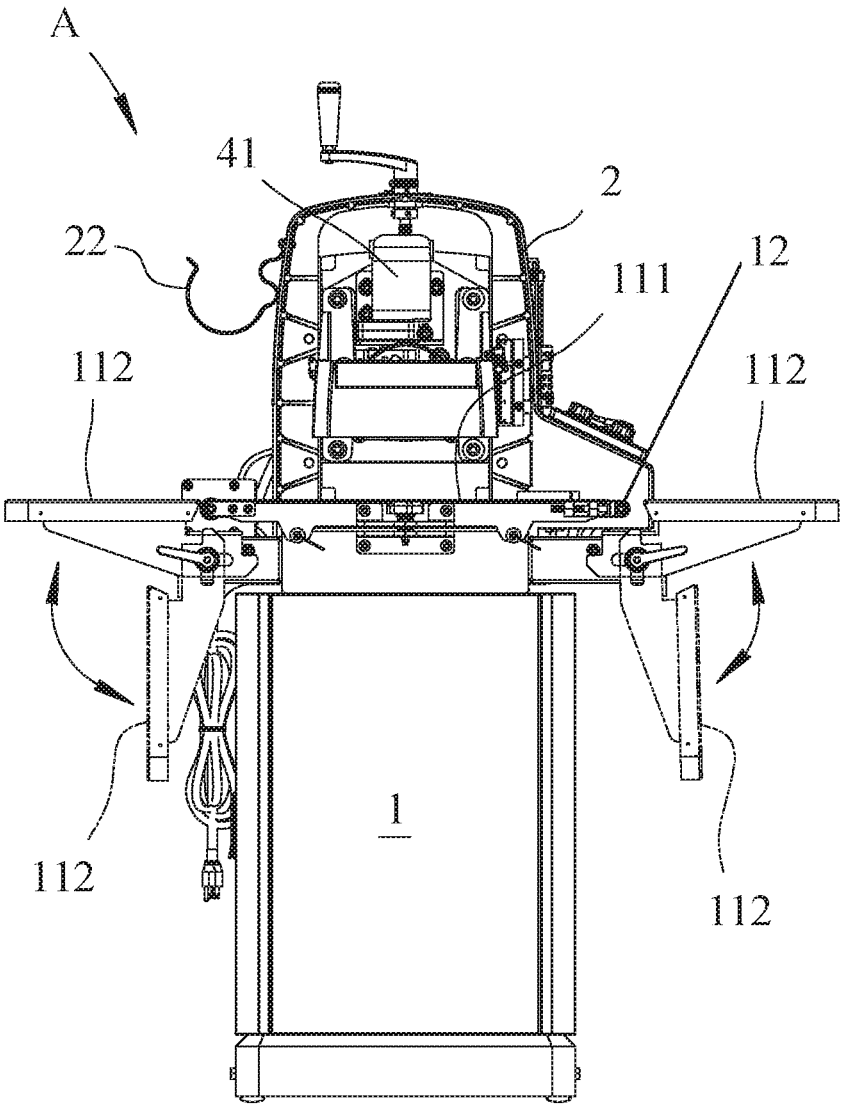
FIG. 9 shows that the secondary plate is foldable relative to the main plate.

Furthermore, as shown in FIGS. 2 and 9, the two secondary plates 112 can be folded relative to the main plate 111 to save storage space. When the two secondary plates 112 are expanded, the wider object 5 can be well supported.

While we have shown and described the embodiment in accordance with the present invention, it should be clear to those skilled in the art that further embodiments may be made without departing from the scope of the present invention.

What is claimed is:

1. A grinding machine comprising:

a base having a plate on a top thereof for supporting an object to be moved by a movable device thereon;

a driving unit connected to one end of the base and having a first driving motor, the first motor having a hollow shaft which includes an oval hole formed peripherally thereon;

a grinding unit disposed above the plate, the grinding unit including a body and a grinding part, the grinding part slidably coupled to a slot defined within the body, the grinding part having a shaft unit engaging the hollow shaft of the first motor to be rotatably driven thereby, and a transverse moving unit connected to the grinding unit, the transverse moving unit including a second driving motor and a cam link coupled to the grinding part, the cam link driven by the second driving motor independent of the first driving motor to move the grinding part along the slot of the body and transversely relative to the plate.

2. The grinding machine as claimed in claim 1, wherein the grinding part includes a grinding wheel, and the shaft unit includes a shaft extending coaxially from the grinding wheel and two blocks respectively connected to the shaft to project radially outward therefrom through the oval hole of the hollow shaft.

3. The grinding machine as claimed in claim 1, wherein the second driving motor is a variable-speed motor or a fixed-speed motor.

4. The grinding machine as claimed in claim 1, wherein the driving unit includes a frame to which the first driving motor is mounted.

5. The grinding machine as claimed in claim 4, wherein the frame includes a hook extending from one side thereof.

6. The grinding machine as claimed in claim 1, wherein the plate includes a main plate and two secondary plates, each secondary plate pivotably connected at a peripheral side of the main plate.

* * * * *